US010605125B2

(12) United States Patent
McCarthy et al.

(10) Patent No.: US 10,605,125 B2
(45) **Date of Patent: *Mar. 31, 2020**

(54) SWITCHING ROCKER ARM

(71) Applicant: Eaton Corporation, Cleveland, OH (US)

(72) Inventors: James E. McCarthy, Kalamazoo, MI (US); Matthew Vance, Kalamazoo, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/194,870

(22) Filed: Nov. 19, 2018

(65) Prior Publication Data

US 2019/0085732 A1 Mar. 21, 2019

Related U.S. Application Data

(63) Continuation of application No. 15/649,029, filed on Jul. 13, 2017, now Pat. No. 10,132,204, which is a (Continued)

(51) Int. Cl.
*F01L 1/00* (2006.01)
*F01L 1/18* (2006.01)
(Continued)

(52) U.S. Cl.
CPC ..... *F01L 1/185* (2013.01); *F01L 1/047* (2013.01); *F01L 1/46* (2013.01); *F01L 13/0036* (2013.01);
(Continued)

(58) Field of Classification Search
CPC ..... F01L 1/02; F01L 1/12; F01L 13/00; F01L 13/0036; F01L 13/0021; F01L 1/18
(Continued)

(56) References Cited

U.S. PATENT DOCUMENTS 6,467,445 B1 10/2002 Harris
8,393,308 B2 3/2013 Kang et al.
(Continued)

FOREIGN PATENT DOCUMENTS

CN 101161998 A 4/2008
CN 101595280 A 12/2009
(Continued)

OTHER PUBLICATIONS

Chinese Office Action for CN Application No. 201680008763.8 dated Mar. 5, 2019.
(Continued)

*Primary Examiner* — John Kwon
(74) *Attorney, Agent, or Firm* — RMCK Law Group PLC

(57) ABSTRACT

A rocker arm assembly includes an outer arm having first and second low lift lobe contacting surfaces, an inner arm, and a latch assembly. The inner arm includes first and second opposed sidewalls extending between a first end and a second end, and a high lift lobe contacting surface disposed between the first and second opposed sidewalls. The first end is pivotably secured to the outer arm and operably associated with an engine valve, and the second end is operably associated with a lash adjuster and defining a latch bore. The latch assembly is movable between a first configuration and a second configuration. In the first configuration, the latch assembly engages the outer arm such that the outer arm rotates with the inner arm, and in the second configuration, the latch assembly disengages the outer arm such that the outer arm rotates independently from the inner arm.

24 Claims, 9 Drawing Sheets

Related U.S. Application Data continuation of application No. PCT/US2016/012997, filed on Jan. 12, 2016.

(60) Provisional application No. 62/103,056, filed on Jan. 13, 2015.

(51) Int. Cl.

| | |
|---|---|
| ***F01L 13/00*** | (2006.01) |
| ***F02M 26/01*** | (2016.01) |
| ***F01L 1/047*** | (2006.01) |
| ***F01L 1/46*** | (2006.01) |
| ***F02D 13/02*** | (2006.01) |
| *F01L 1/24* | (2006.01) |
| *F01L 1/08* | (2006.01) |
| *F01L 1/20* | (2006.01) |

(52) U.S. Cl.

CPC ..... *F02D 13/0207* (2013.01); *F02M 26/01* (2016.02); *F01L 1/08* (2013.01); *F01L 1/20* (2013.01); *F01L 1/2405* (2013.01); *F01L 2001/186* (2013.01); *F01L 2001/467* (2013.01); *F01L 2105/00* (2013.01); *F01L 2201/00* (2013.01); *F01L 2800/10* (2013.01); *F01L 2820/01* (2013.01)

(58) Field of Classification Search

USPC ..... 123/90.1, 90.16, 90.2, 90.39, 90.44, 123/90.45, 90.52, 90.6, 90.61

See application file for complete search history.

(56) References Cited

U.S. PATENT DOCUMENTS

| | | | | |
|---|---|---|---|---|
| 10,132,204 | B2 * | 11/2018 | McCarthy, Jr. ..... | F01L 1/185 |
| 2004/0182340 | A1 | 9/2004 | Cecur | |
| 2007/0000460 | A1 | 1/2007 | Roerig et al. | |
| 2007/0113809 | A1 | 5/2007 | Harman et al. | |
| 2007/0113813 | A1 | 5/2007 | Lalone | |
| 2008/0000438 | A1 | 1/2008 | Pierik | |
| 2011/0303174 | A1 | 12/2011 | Ezaki et al. | |
| 2013/0000582 | A1 | 1/2013 | Church | |
| 2013/0239919 | A1 | 9/2013 | Manther | |
| 2013/0312506 | A1 | 11/2013 | Nielsen et al. | |
| 2014/0041608 | A1 | 2/2014 | Zurface | |
| 2015/0128890 | A1 | 5/2015 | Cecur | |
| 2016/0138435 | A1 | 5/2016 | Zurface et al. | |
| 2018/0003088 | A1 | 1/2018 | Nielsen et al. | |
| 2018/0058275 | A1 | 3/2018 | Radulescu et al. | |
| 2018/0119584 | A1 | 5/2018 | Vance et al. | |
| 2018/0156140 | A1 | 6/2018 | Vance et al. | |

FOREIGN PATENT DOCUMENTS

| | | | |
|---|---|---|---|
| CN | 203547817 | U | 4/2014 |
| CN | 104100324 | A | 10/2014 |
| JP | 2015534005 | A | 11/2015 |
| WO | 2008041276 | A1 | 4/2008 |

OTHER PUBLICATIONS

European Search Report for EP Application No. 16737712.6 dated Aug. 6, 2018, 7 pages.

International Search Report and Written Opinion for International Application No. PCT/US2016/012997 dated Mar. 30, 2016, 12 pages.

* cited by examiner

SWITCHING ROCKER ARM

CROSS-REFERENCE TO RELATED APPLICATIONS

This application is a continuation of U.S. Pat. No. 10,132,204, filed Jul. 13, 2017, which is a continuation of International Application No. PCT/US2016/012997 filed Jan. 12, 2016, which claims priority to U.S. Provisional Application No. 62/103,056 filed on Jan. 13, 2015, which is incorporated by reference in its entirety as if set forth herein.

FIELD

The present disclosure relates generally to rocker arms for internal combustion engines and, more particularly, to switching rocker arms for use in a valve train assembly of an internal combustion engine.

BACKGROUND

Switching rocker arms allow for control of valve actuation by alternating between two or more states, usually involving multiple arms, such as in inner arm and outer arm. In some circumstances, these arms engage different cam lobes, such as low-lift lobes, high-lift lobes, and no-lift lobes. Mechanisms are required for switching rocker arm modes in a manner suited for operation of internal combustion engines.

SUMMARY

In one aspect of the present disclosure, a rocker arm assembly is disclosed. The rocker arm assembly includes an outer arm having first and second low lift lobe contacting surfaces, an inner arm, and a latch assembly. The inner arm includes first and second opposed sidewalls extending between a first end and a second end, and a high lift lobe contacting surface disposed between the first and second opposed sidewalls. The first end is pivotably secured to the outer arm and operably associated with an engine valve, and the second end is operably associated with a lash adjuster and defining a latch bore. The latch assembly is arranged at least partially within the latch bore, the latch assembly movable between a first configuration and a second configuration. In the first configuration, the latch assembly engages the outer arm such that the outer arm rotates with the inner arm, and in the second configuration, the latch assembly disengages the outer arm such that the outer arm rotates independently from the inner arm.

In addition to the foregoing, the rocker arm assembly may include one or more of the following features: wherein the first and second opposed sidewalls each include an aperture configured to receive an axle; wherein the high lift lobe contacting surface comprises a roller disposed on the axle, and each low lift lobe contacting surface comprises a contact pad; wherein the inner arm second end includes a first post and a second post extending outwardly therefrom, the first post disposed between the inner arm second end and the outer arm, and the second post disposed between the inner arm second end and the outer arm; and a first lost motion spring disposed on the first post, and a second lost motion spring disposed on the second post.

In addition to the foregoing, the rocker arm assembly may include one or more of the following features: wherein the inner arm second end includes a first tab and a second tab extending outwardly therefrom; wherein the first lost motion spring includes a first end, a second end, and a plurality of spring coils therebetween, wherein the spring first end engages the first tab, and the spring second end engages the outer arm; wherein the latch assembly is in a normally latched position by default, the normally latched position being the first configuration where the latch assembly engages the outer arm; and wherein the latch assembly in the normally latched position is configured to provide internal exhaust gas recirculation (IEGR) during engine startup and idle between approximately zero rpm and approximately 800 rpm.

In another aspect of the present disclosure, an internal combustion engine is disclosed. The internal combustion engine includes a lash adjuster mounted to an engine block, an engine valve configured to selectively open and close an exhaust or intake passage, and a rocker arm assembly coupled to the lash adjuster at a first end and engaged with the cylinder valve at a second end opposite the first end. The rocker arm assembly includes an outer arm having first and second low lift lobe contacting surfaces, an inner arm, and a latch assembly. The inner arm includes first and second opposed sidewalls extending between a first end and a second end, and a high lift lobe contacting surface disposed between the first and second opposed sidewalls. The first end is pivotably secured to the outer arm and engaged with the cylinder valve, and the second end is pivotably secured to the lash adjuster and defining a latch bore. The latch assembly is arranged at least partially within the latch bore, the latch assembly movable between a first configuration and a second configuration. In the first configuration, the latch assembly engages the outer arm such that the outer arm rotates with the inner arm, and in the second configuration, the latch assembly disengages the outer arm such that the outer arm rotates independently from the inner arm. The engine further includes a cam having a high lift lobe and two low lift lobes, each of the high and low lift lobes including an actuating portion and a non-actuating portion, the cam rotating during operation of the internal combustion engine such that the actuating portions interact with the rocker arm assembly to rotate at least one of the inner and outer arms.

In addition to the foregoing, the internal combustion engine may include one or more of the following features: wherein the first and second opposed sidewalls each include an aperture configured to receive an axle; wherein the high lift lobe contacting surface comprises a roller disposed on the axle, and each low lift lobe contacting surface comprises a contact pad; wherein the low lift lobes respectively contact the first and second low lift lobe contacting surfaces, and the high lift lobe contacts the high lift lobe contacting surface; and wherein the inner arm second end includes a first post and a second post extending outwardly therefrom, the first post disposed between the inner arm second end and the outer arm, and the second post disposed between the inner arm second end and the outer arm.

In addition to the foregoing, the internal combustion engine may include one or more of the following features: a first lost motion spring disposed on the first post, and a second lost motion spring disposed on the second post; wherein the inner arm second end includes a first tab and a second tab extending outwardly therefrom; wherein the first lost motion spring includes a first end, a second end, and a plurality of spring coils therebetween, wherein the spring first end engages the first tab, and the spring second end engages the outer arm; and wherein the latch assembly is positioned over a pivot between the inner arm second end and the lash adjuster to improve static and dynamic stability.

In addition to the foregoing, the internal combustion engine may include one or more of the following features: wherein the first and second lost motion springs are disposed over a pivot between the inner arm second end and the lash adjuster, and wherein the outer arm includes at least one over-travel limiter configured to contact one or more oil galleries in an overspeed condition; and wherein the latch assembly is in a normally unlatched position by default, the normally unlatched position being the second configuration where the latch assembly is disengaged from the outer arm, and the normally unlatched position configured to provide internal exhaust gas recirculation (IEGR) at near idle speeds.

In yet another aspect of the present disclosure, a vehicle is disclosed. The vehicle includes an internal combustion engine comprising a lash adjuster mounted to an engine block, an engine valve configured to selectively open and close an exhaust or intake passage, and a rocker arm assembly coupled to the lash adjuster at a first end and engaged with the cylinder valve at a second end opposite the first end. The rocker arm assembly includes (a) an outer arm having first and second low lift lobe contacting surfaces, (b) an inner arm having first and second opposed sidewalls extending between a first end and a second end, and a high lift lobe contacting surface disposed between the first and second opposed sidewalls, the first end pivotably secured to the outer arm and engaged with the cylinder valve, and the second end pivotably secured to the lash adjuster and defining a latch bore, and (c) a latch assembly arranged at least partially within the latch bore, the latch assembly movable between a first configuration and a second configuration, wherein in the first configuration, the latch assembly engages the outer arm such that the outer arm rotates with the inner arm, and in the second configuration, the latch assembly disengages the outer arm such that the outer arm rotates independently from the inner arm. The engine further includes a cam having a high lift lobe and two low lift lobes, each of the high and low lift lobes including an actuating portion and a non-actuating portion, the cam rotating during operation of the internal combustion engine such that the actuating portions interact with the rocker arm assembly to rotate at least one of the inner and outer arms. The vehicle further includes an oil control valve system comprising an engine control unit (ECU) in signal communication with an oil control valve fluidly coupled to the latch assembly, the oil control valve configured to selectively supply a pressurized oil to the latch assembly to move the latch assembly between the first configuration and the second configuration.

In addition to the foregoing, the vehicle may include one or more of the following features: wherein the outer arm extends along a first axis, and the bore and the latch assembly extend along a second axis that is substantially parallel to the first axis and wherein the inner arm second end includes a first post and a second post extending outwardly therefrom, the first post disposed between the inner arm second end and the outer arm, and the second post disposed between the inner arm second end and the outer arm.

In addition to the foregoing, the vehicle may include one or more of the following features: a first lost motion spring disposed on the first post, and a second lost motion spring disposed on the second post, wherein the inner arm second end includes a first tab and a second tab extending outwardly therefrom, and wherein the first lost motion spring includes a first end, a second end, and a plurality of spring coils therebetween, wherein the spring first end engages the first tab, and the spring second end engages the outer arm; and wherein the latch assembly is positioned over a pivot between the inner arm second end and the lash adjuster to improve static and dynamic stability and wherein the first and second lost motion springs are disposed over a pivot between the inner arm second end and the lash adjuster.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
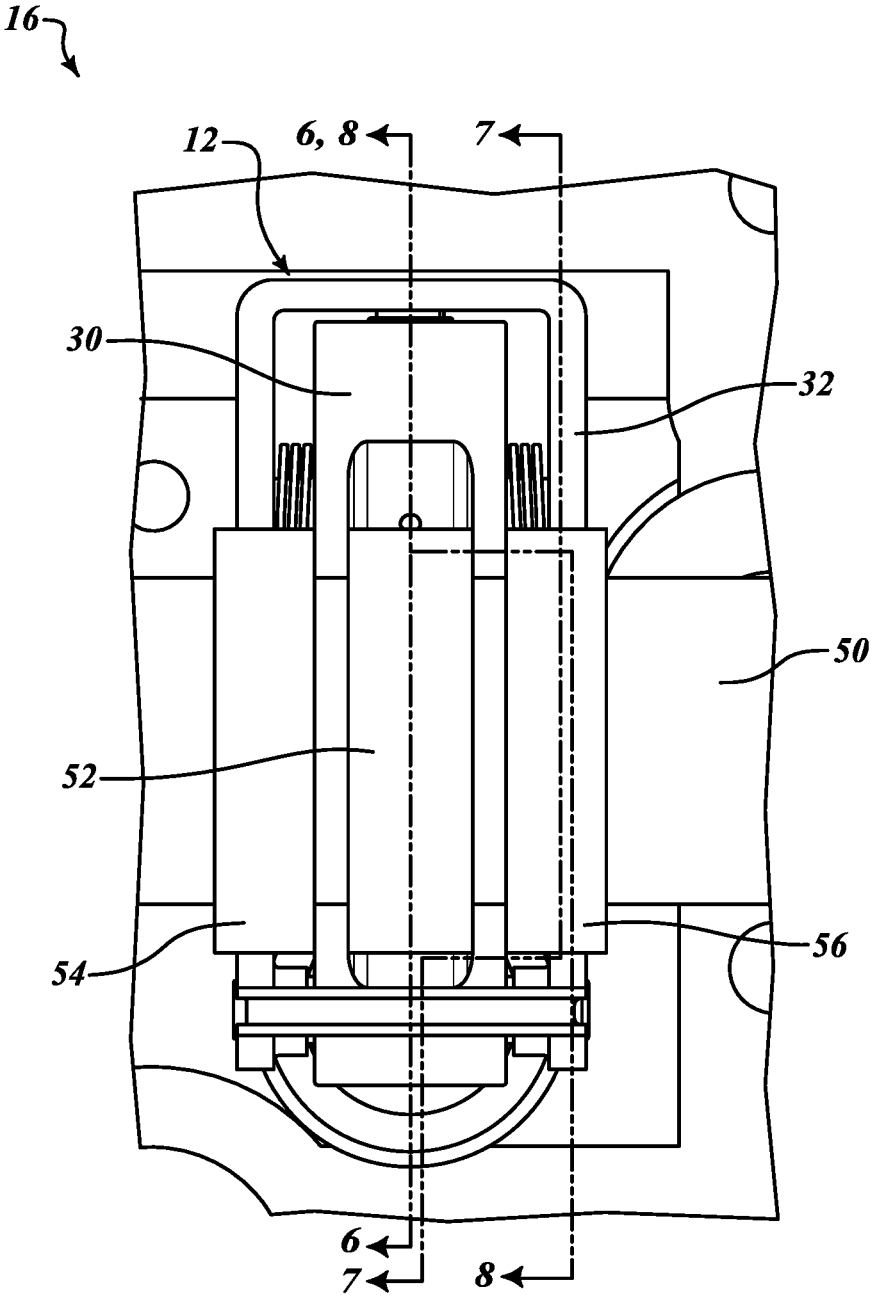
FIG. 1 is a plan view of a partial valve train assembly incorporating a rocker arm assembly in a cylinder head constructed in accordance to one example of the present disclosure.

Certain terminology will be used in the following description for convenience in describing the figures will not be limiting. The terms "upward," "downward," and other directional terms used herein will be understood to have their normal meanings and will refer to those directions as the drawing figures are normally viewed.

This application is related to the disclosure in PCT Publication No. WO2015/181264, published Dec. 3, 2015, the contents of which are incorporated herein by reference.

With initial reference to FIGS. 1-5, a partial valve train assembly constructed in accordance with one example of the present disclosure is shown and generally identified at reference 10. The valve train assembly 10 can generally include a dual-lift or switching rocker arm 12 configured for operation with a three lobed cam assembly 14 (FIG. 1), a lash adjuster 16, and an engine valve 18 (FIG. 4) for an internal combustion engine cylinder.

The switching rocker arm 12 can include an inner body or arm 30 and an outer body or arm 32. The inner arm 30 can be pivotally mounted on a shaft or pivot axle 34, which serves to link the inner arm 30 and the outer arm 32 together. A first end 36 of the inner arm 30 engages a stem 38 of the valve 18, and a second end 40 of the inner arm 30 is mounted for pivotal movement on the lash adjuster 16, which is supported in an engine block (not shown). The lash adjuster 16 may be, for example, a hydraulic lash adjuster, which is used to accommodate lash between components in the valve train assembly 10.

The inner arm 30 can include a main or high lift roller 42 rotatably mounted on an axle 44 carried by the inner arm 30, and the outer arm 32 can include a pair of sliding contacts or pads 46, 48 disposed on either side of the outer arm 32. Alternatively, low lift rollers (not shown) may be disposed on or in either side of outer arm 32 instead of pads 46 and 48, to reduce friction and improve fuel efficiency. In other alternative configurations, the rollers may be high lift rollers disposed on or in either side of the outer arm 32, and roller 42 can be a low lift roller. In one aspect, the rocker arm 12 can include pads 46, 48 (instead of rollers) without significant loss in fuel economy compared with rollers due to the low lift event (e.g., IEGR) having such a small lift, which does not generate a high amount of friction that could adversely affect the fuel economy.

The three lobed cam assembly 14 can generally include a rotatable camshaft 50 having a main or high lift cam 52, and first and second secondary or low lift cams 54, 56 mounted thereon. The high lift cam 52 is positioned between the two low lift cams 54, 56. The high lift cam 52 is configured to engage the high lift roller 42, the first low lift cam 54 is configured to engage contact pad 46, and the second low lift cam 56 is configured to engage contact pad 48.

The high lift cam 52 can include a high lift profile or lobe 58 and a base circle 60, the first low lift cam 54 can include a low lift profile or lobe 62 and a base circle 64, and the low lift cam 56 can include a low lift profile or lobe 66 and a base circle 68. The high lift lobe 58 is angularly offset from the low lift lobes 62, 66, and is larger than the lobes 62, 66 both in terms of the height of its peak and in terms of the length of its base. The low lift lobes 62, 66 have the same or substantially the same dimensions as each other and are angularly aligned.

The rocker arm 12 is switchable between a dual lift mode and a single lift mode. The dual lift mode provides two operations of the valve 18 (a valve operation is an opening and corresponding closing of the valve) per engine cycle (e.g., a full rotation of the camshaft 50). The single lift mode provides a single operation of the valve 18 per engine cycle. In the dual lift mode, the inner arm 30 and the outer arm 32 can be latched together by a latch assembly 70 (see FIGS. 6 and 7) such that they act as a single solid body. With this particular arrangement, the dual lift mode can provide a higher main valve lift and a lower secondary valve lift per engine cycle. The single lift mode provides just the main valve lift per engine cycle.

During engine operation in the dual lift mode (FIGS. 6 and 7), as the camshaft 50 rotates, the high lift lobe 58 engages the high lift roller 42 and exerts a force that causes the inner arm 30 to pivot about the lash adjuster 16 to lift the valve stem 38 (i.e., move it downwards as shown) against the force of a valve spring (not shown), thereby opening the valve 18. As the high lift lobe 58 passes out of engagement with the high lift roller 42, the valve spring begins to close the valve 18 (i.e., the valve stem 38 is moved upwards as shown). When the high lift cam's base circle 60 engages the high lift roller 42, the valve is fully closed and the main valve lift or high lift event is complete.

As the camshaft 50 continues to rotate, the low lift cam lobes 62, 66 can simultaneously engage respective contact pads 46, 48, thereby exerting a force on the outer arm 32, which is transmitted to the inner arm 30 due to the latching engagement between the inner and outer arms 30, 32. As such, the inner arm 30 can pivot about the lash adjuster 16 to lift the valve stem 38 against the force of the valve spring, thereby opening the valve 18 a second time during the engine cycle.

As the peak of the lobes 62, 66 pass out of engagement with the low lift contact pads 46, 48, the valve spring can begin to close valve 18 again. When the low lift cam's base circle 64 engages contact pad 46 and the low lift cam's base circle 68 engages the contact pad 48, the valve 18 is fully closed and the secondary valve lift or low lift event for the current engine cycle is complete.

Figure 6:
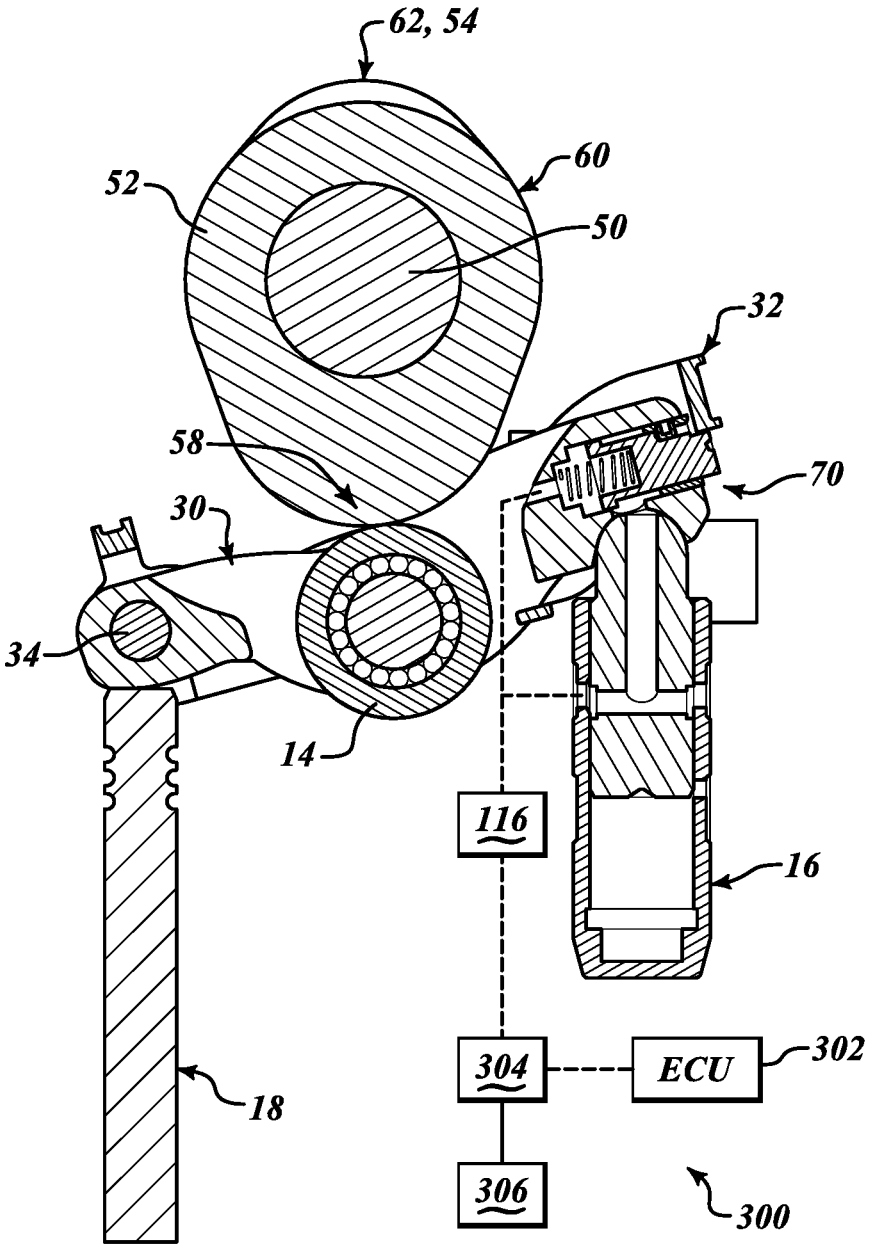
FIG. 6 is a cross-sectional view of an example oil control valve system with the partial valve train assembly shown in FIG. 1 taken along line 6-6 and in a high lift position of a latched dual lift mode.

As shown in FIG. 6, the lift profiles 62, 66 are shallower and narrower than the high lift profile 58, which can cause the low lift event to have a shorter duration than the high lift event.

During operation in the single lift mode (FIGS. 8 and 9), the inner arm 30 and the outer arm 32 are not latched together by the latch assembly 70. As such, in this mode, the inner arm 30 is free to pivot with respect to the outer arm 32 about the pivot axle 34. During engine operation in the single lift mode, as the camshaft 50 rotates, the high lift lobe 58 engages the high lift roller 42 in an identical way as in the dual lift mode, to thereby produce the high lift event.

Figure 2:
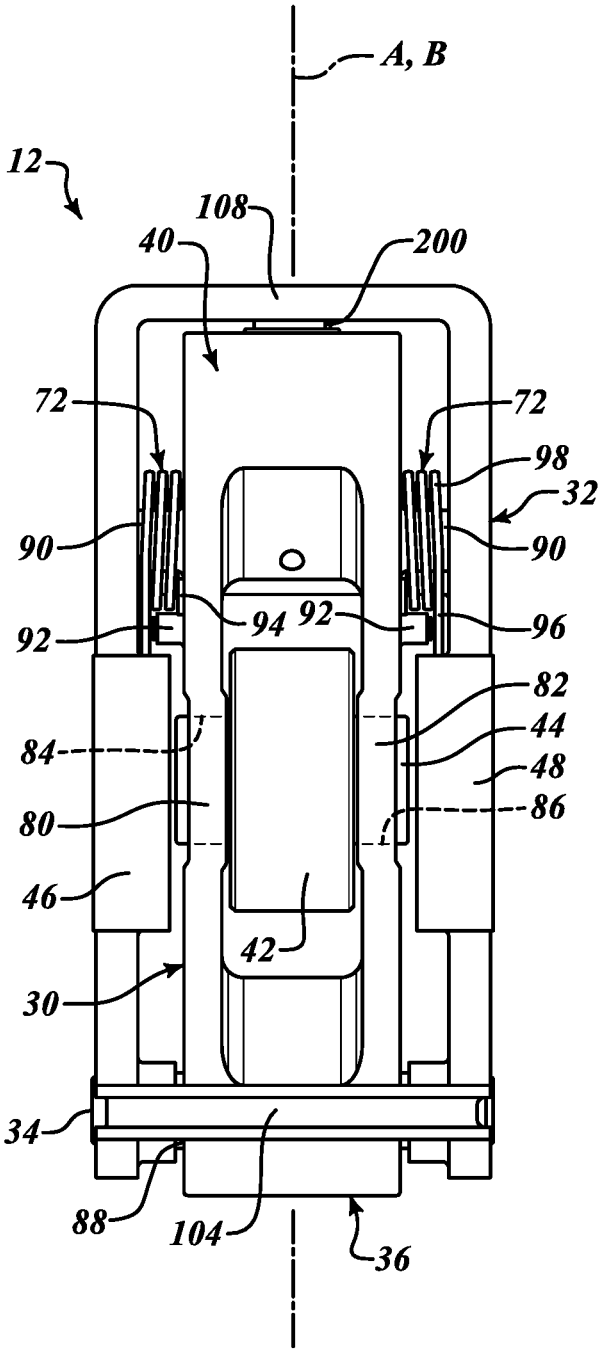
FIG. 2 is a plan view of the rocker arm assembly shown in FIG. 1.
Figure 3:
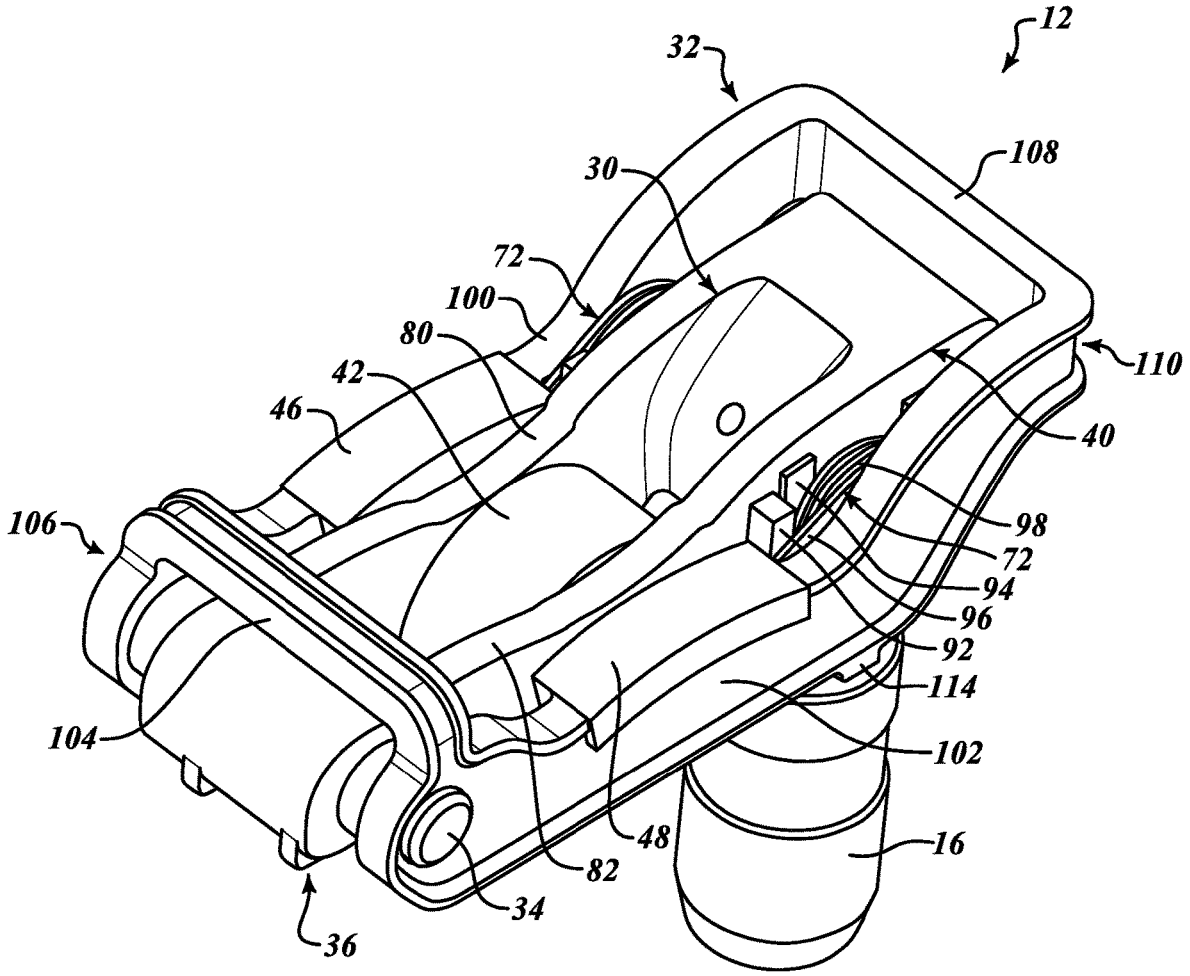
FIG. 3 is a perspective view of the rocker arm assembly shown in FIG. 1.

As the camshaft 50 continues to rotate, the low lift lobes 62, 66 respectively engage the contact pads 46, 48 to exert a force on the outer arm 32. However, because the inner arm 30 and the outer arm 32 are not latched together in the single lift mode, the force is not transmitted to the inner arm 30. Accordingly, the inner arm 30 does not subsequently pivot about the lash adjuster 16 or open the valve 18. As such, there is no additional valve event during the engine cycle. Instead, as the low lift lobes 62, 66 engage the contact pads 46, 48, the outer arm 32 pivots with respect to the inner arm 30 about the pivot axle 34, thereby accommodating the motion that otherwise would be transferred to the inner arm 30. As shown in FIGS. 2 and 3, a pair of torsional lost motion springs 72 are provided to return the outer arm 32 to its starting position relative to the inner arm 30, once the peaks of the low lift lobes 62, 66 have passed out of engagement with the contact pads 46, 48.

In one example, this arrangement may be used to provide switchable Internal Exhaust Gas Recirculation (IEGR) control. For example, if the valve 18 is an exhaust valve for an engine cylinder, the high lift acts as the main exhaust lift of an engine cycle, and the timing of the low lift may be arranged so that it occurs when an intake valve for that cylinder, controlled by a further rocker arm mounted pivotally on a further lash adjuster and which pivots in response to an intake cam mounted on the camshaft 50, is open. The simultaneous opening of the intake and exhaust valves in this way ensures that a certain amount of exhaust gas remains in the cylinder during combustion, which reduces NOx emissions. Switching to the single lift mode deactivates the IEGR function, which may be desirable under certain engine operating conditions. As will be appreciated by those skilled in the art, this switchable IEGR control may also be provided if the valve 18 is an intake valve with the timing of the low lift arranged to occur when an exhaust valve for that cylinder is open during the exhaust part of an engine cycle.

With further reference to FIGS. 2-5, the inner arm 30 can generally include a pair of opposed sidewalls 80, 82 extending between the first end 36 and the second end 40. The sidewalls 80, 82 can respectively include apertures 84, 86 (FIG. 2) configured to receive roller axle 44. The first end 36 can include an aperture 88 (FIG. 2) configured to receive the pivot axle 34, and the second end 40 can include opposed posts 90 and opposed tabs 92 outwardly extending therefrom. The posts 90 can each receive a lost motion torsion spring 72 such that springs 72 are disposed between inner arm 30 and outer arm 32.

In the illustrated example, each torsion spring 72 includes a first end 94, a second end 96, and a plurality of spring coils 98 (i.e., one turn of the spring) disposed therebetween. The torsion springs 72 are disposed at least partially over the pivot between the inner arm second end 40 and the lash adjuster 16. The spring first end 94 abuts against tab 92, and the spring second 96 abuts against the outer arm 32. As such, torsion springs 72 function to bias the outer arm 32 upwardly after being displaced by the low lift lobes 62, 66. In the illustrated example, torsion spring 72 includes a small number of spring coils 98 (e.g., three), due to the low IEGR lift, which requires less lift than some other applications.

Outer arm 32 can generally include a first outer side arm 100 and a second outer side arm 102 coupled by a connecting bar 104 at a first end 106, and a connecting wall 108 at a second end 110. The inner arm 30 is disposed between the first outer side arm 100 and second outer side arm 102. The inner arm 30 and outer arm 32 are both mounted to the pivot axle 34, located adjacent the first end of the rocker arm 12, which secures the inner arm 30 to the outer arm 32 while also allowing a rotational degree of freedom about the pivot axle 34 of the inner arm 30 with respect to the outer arm 32. In addition to the illustrated example having a separate pivot axle 34 mounted to the outer arm 32 and inner arm 30, the pivot axle 34 may be part of the outer arm 32 or the inner arm 30.

Figure 4:
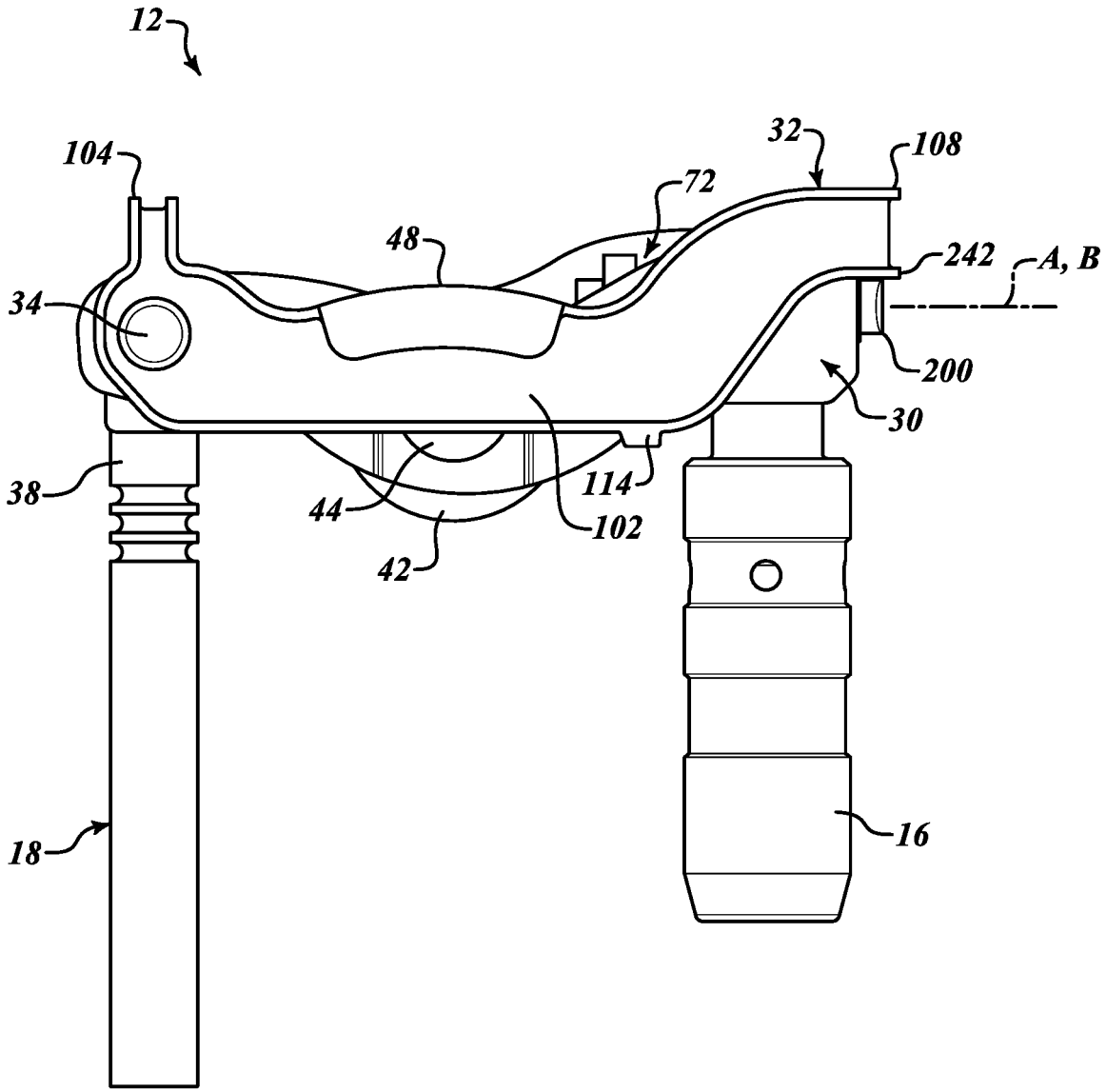
FIG. 4 is a side view of the rocker arm assembly shown in FIG. 1.
Figure 5:
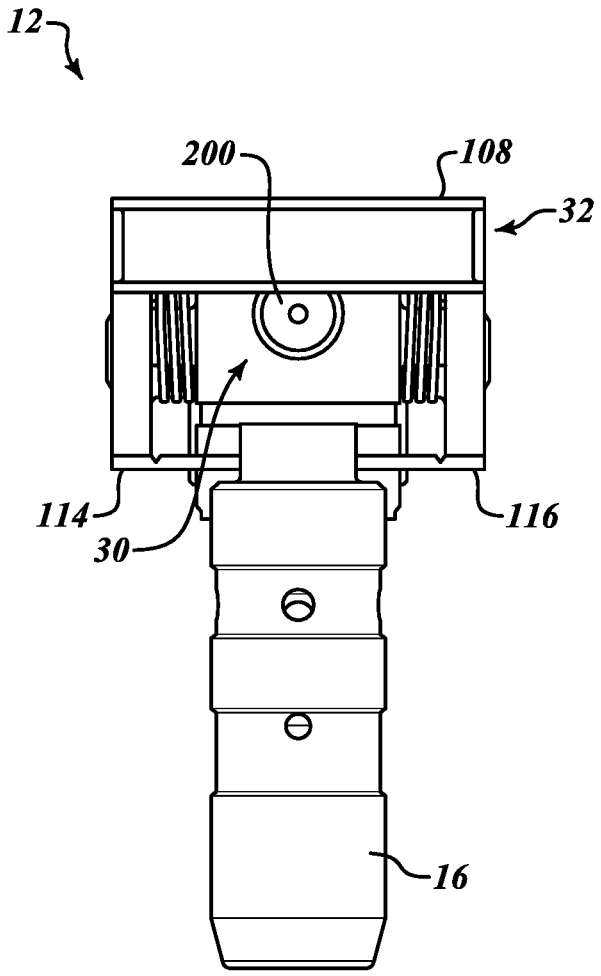
FIG. 5 is a front view of the rocker arm assembly shown in FIG. 1.

As shown in FIGS. 3 and 4, first and second outer side arms 100, 102 can respectively include first and second over-travel limiters 112, 114 extending from a lower surface of the second end 110. The first and second over-travel limiters 112, 114 can prevent over-coiling of the torsion springs 72, which can exceed the stress capability of the springs 72. The over-travel limiters 112, 114 may contact the one or more oil galleries 116 (FIG. 7) in an overspeed condition during the low lift mode. At this point, the interference between the over-travel limiters 112, 114 and the galleries 116 can stop any further downward rotation of the outer arm 32.

As shown in FIGS. 6-9, inner arm second end 40 can include the latch assembly 70, which can be selectively moved between a latched position (i.e., the dual lift mode, FIGS. 6 and 7) and an unlatched position (i.e., the single lift mode, FIGS. 8 and 9) by an oil control valve system 300. The latched position can latch the inner arm 30 to the outer arm 32, and the unlatched position can allow relative motion between the inner arm 30 and the outer arm 32.

As illustrated in FIG. 6, the oil control valve system 300 is operably coupled to the latch assembly 70 and the lash adjuster 16 for control thereof. The oil control valve system 300 can generally include a controller or engine control unit (ECU) 302 in signal communication with an oil control valve 304 that is in fluid communication with an engine oil supply 306. The ECU 302 can control the oil control valve 304 to communicate engine oil to the latch assembly 70 of the rocker arm 12. Actuation of the latch assembly 70 between the dual lift mode and the single lift mode can result from pressurized oil communicated from the oil control valve 304. In the particular example shown, the oil control valve 304 delivers oil at a higher pressure through the oil gallery 116 to the lash adjuster 16 (e.g., a single or dual feed). The lash adjuster 16 supplies the oil to the latch assembly 70 to switch to the dual lift mode. However, other configurations are contemplated. For example, the lash adjuster 16 can supply the oil to the latch assembly 70 to switch to the single lift mode. The oil control valve system 300 may be fluidly coupled to additional rocker arms and latch assemblies (not shown).

With continued reference to FIGS. 6-9, latch assembly 70 is positioned over a pivot between the inner arm second end 40 and the lash adjuster 16 and extends horizontally along axis 'A' such that the latch assembly is parallel to or substantially parallel a longitudinal axis 'B' of the outer arm 32. In this arrangement, a majority of the weight of the rocker arm 12 is positioned over the pivot, thereby improving the static and dynamic stability of the rocker arm 12, and providing proximity to the latch assembly 70.

Moreover, the latch assembly 70 is in the normally latched position meaning that the rocker arm 12 operates in the dual lift mode by default. The normally latched position can thus provide IEGR during startup and idle, for example, between approximately zero rpm and approximately 800 rpm. However, the latch assembly 70 may be designed to be in a normally unlatched position. In the normally unlatched position, the IEGR can be turned on at near idle speeds. Additionally, an IEGR device (not shown) can be provided that utilizes a single and/or dual feed lash adjusters.

The latch assembly 70 can generally include a latch pin 200, a sleeve 202, an orientation pin 204, and a latch spring 206. The latch assembly 70 is configured to be mounted inside inner arm 30 within a bore 240 having axis 'A' that extends horizontally with outer arm 32. As described herein, the latch pin 200 can be extended in the dual lift mode, securing inner arm 30 to outer arm 32. In the single lift mode, latch pin 200 can be retracted into inner arm 30, allowing lost motion movement of outer arm 32. In the illustrated example, oil pressure provided through the oil gallery 116, which may be controlled, for example, by a solenoid, controls whether latch pin 200 is latched or unlatched. However, other types of actuator may be used for latch assembly control such as, for example, electromechanical systems or pneumatic systems.

Figure 9:
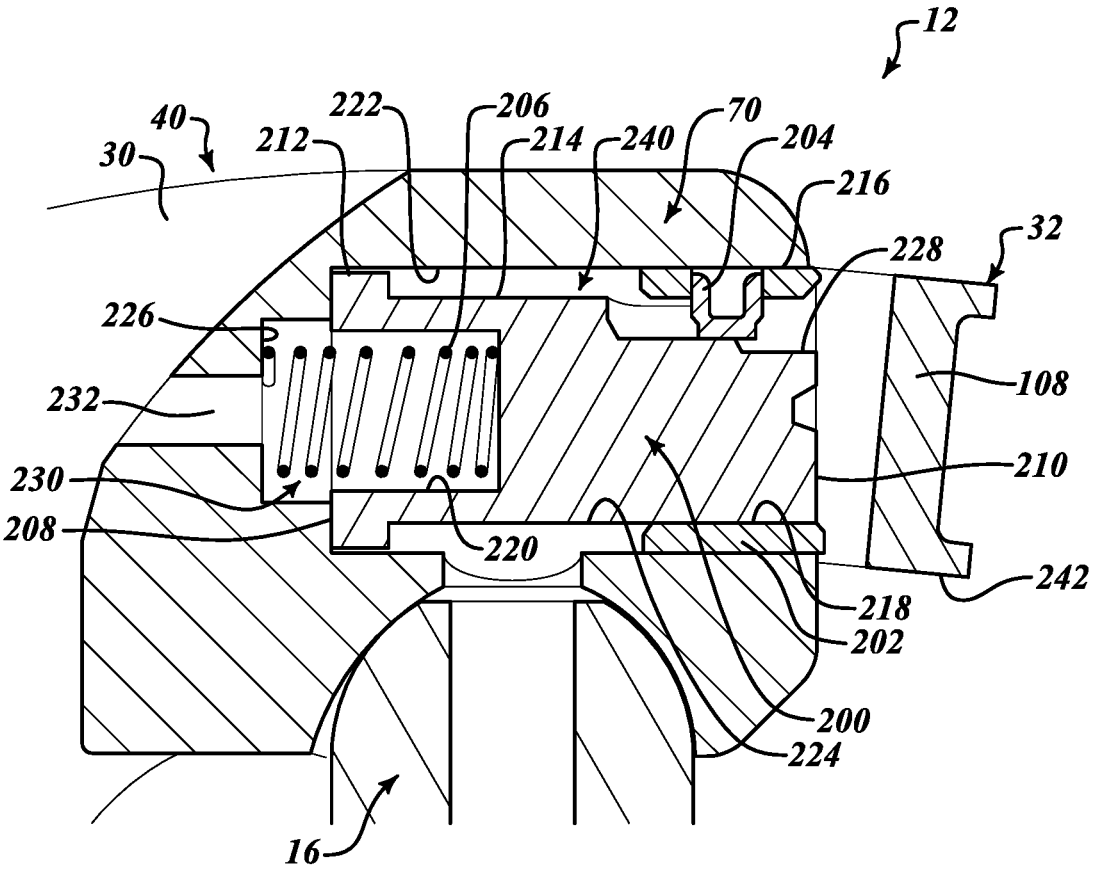
FIG. 9 is an enlarged view of a portion of the valve train assembly shown in FIG. 8.

With further reference to FIG. 9, the latch pin 200 can include a spring bore 220 in which the biasing spring 206 is inserted. The latch pin 200 can include a rear surface 208, a front surface 210, a first generally cylindrical surface 212, and a second generally cylindrical surface 214. The first generally cylindrical surface 212 can have a diameter larger than that of the second generally cylindrical surface 214. The spring bore 220 is generally concentric with surfaces 212, 214.

The sleeve 202 can have a generally cylindrical outer surface 216 and a generally cylindrical inner surface 218. The bore 240 can have a first generally cylindrical bore wall 222 that interfaces the sleeve outer surface 216, and a second generally cylindrical bore wall 224 having a larger diameter than first generally cylindrical bore wall 222. The generally cylindrical outer surface 216 of sleeve 202 and first generally cylindrical surface 212 of latch pin 200 engage first generally cylindrical bore wall 222 to form pressure tight seals. Further, the generally cylindrical inner surface 218 of sleeve 202 also forms a pressure tight seal with second generally cylindrical surface 214 of latch pin 200. These seals allow oil pressure to build in a volume 230, which can encircle the second generally cylindrical surface 214 of the latch pin 200.

Figure 7:
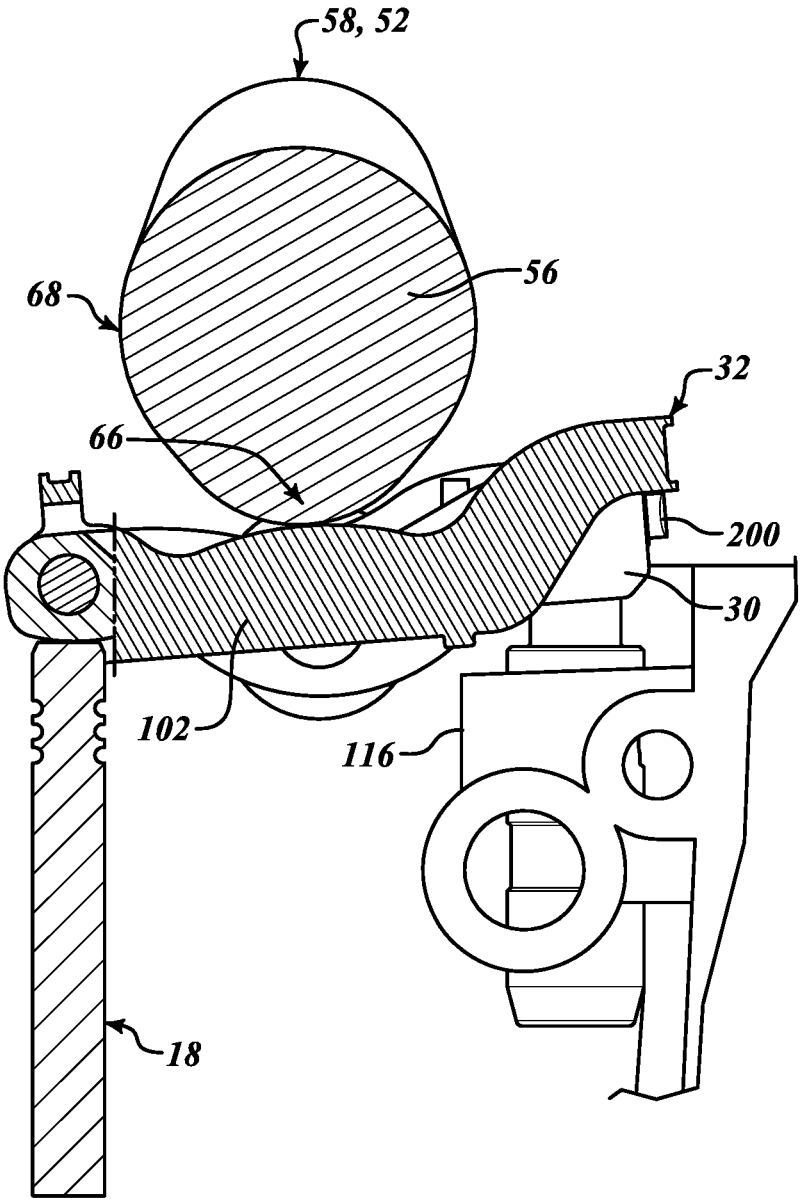
FIG. 7 is a partial cross-sectional view of the partial valve train assembly shown in FIG. 1 taken along line 7-7 and in a low lift position of the latched dual lift mode.

The default position of latch pin 200, shown in FIGS. 6 and 7, is the latched position (i.e., the dual lift mode). The spring 206 can bias the latch pin 200 outwardly from the bore 240 into the latched position. Oil pressure applied to the volume 230 can retract the latch pin 200 and move it into the unlatched position. Other configurations are also possible, such as where spring 206 biases the latch pin 200 in the unlatched position, and application of oil pressure between a rear bore wall 226 and the rear surface 208 causes latch pin 200 to extend outwardly from the bore 240 to latch outer arm 32.

In the latched state (i.e., the single lift mode), latch pin 200 engages a latch engaging surface 242 of outer arm 32 with an arm engaging surface 228. The outer arm 32 is impeded from moving downward and will transfer motion to inner arm 30 through latch assembly 70.

Figure 8:
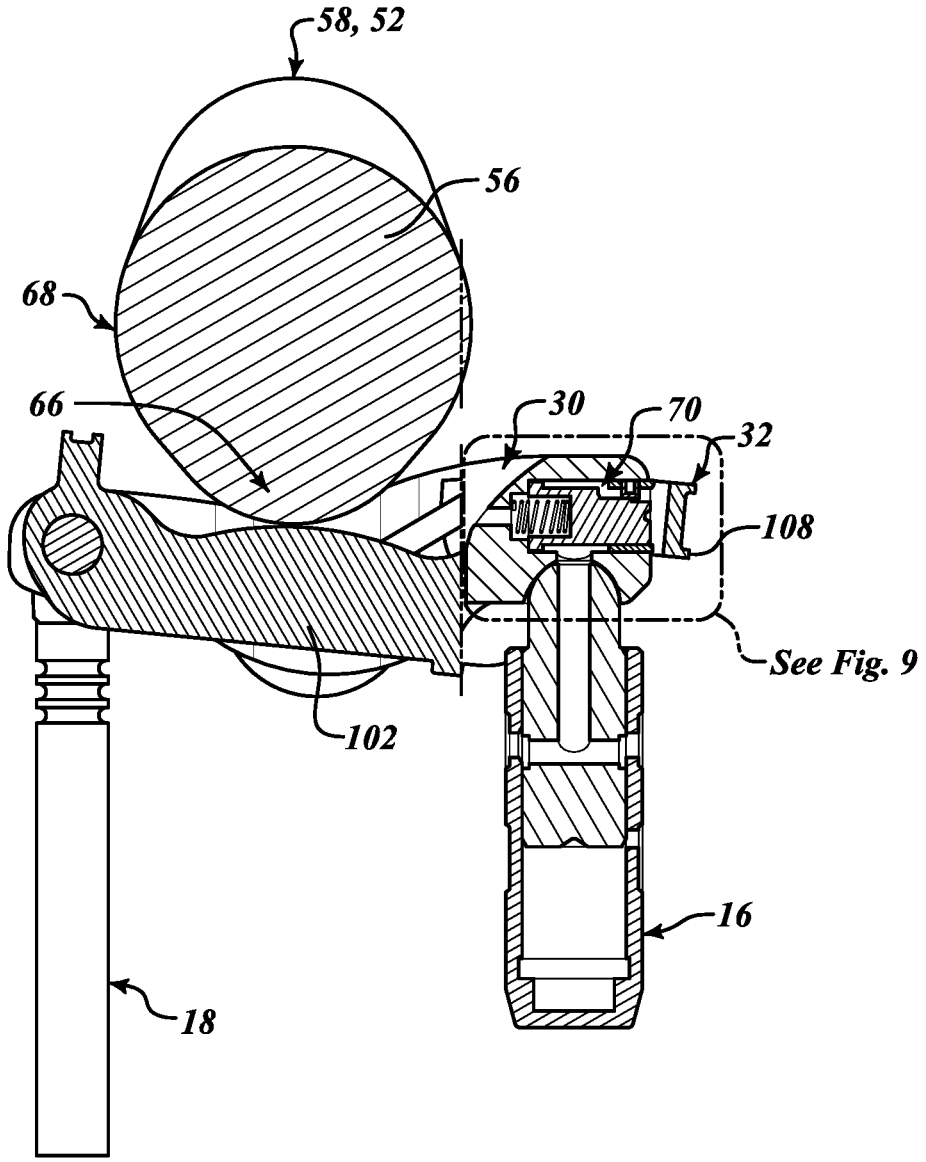
FIG. 8 is a partial cross-sectional view of the partial valve train assembly shown in FIG. 1 taken along line 8-8 and in a lost motion position of an unlatched single lift mode.

As can be seen in FIGS. 8 and 9, upon introduction of pressurized oil into volume 230, the latch pin 200 retracts into bore 240, allowing outer arm 32 to undergo lost motion rotation with respect to inner arm 30. The outer arm 32 is then no longer impeded by the latch pin 200 from moving downward and exhibiting lost motion movement. Pressurized oil is introduced into volume 230 through an oil opening 232, which is in fluid communication with oil gallery 116. As the latch pin 200 retracts, it encounters the bore wall 226 with its rear surface 208. The rear surface 208 of latch pin 200 can have a flat annular or sealing surface 234 that lies generally perpendicular to first and second generally cylindrical bore walls 222, 224 and parallel to bore wall 226. The flat annular surface 234 forms a seal against the bore wall 226, which can reduce oil leakage from volume 230 through the seal formed by the first generally cylindrical surface 212 of latch 200 and the first generally cylindrical bore wall 222.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A rocker arm assembly comprising:

an outer arm having first and second low lift lobe contacting surfaces;

an inner arm having first and second opposed sidewalls extending between a first end and a second end, and a high lift lobe contacting surface disposed between the first and second opposed sidewalls, the first end pivotably secured to the outer arm and operably associated with an engine valve, and the second end operably associated with a lash adjuster and defining a latch bore; and a latch assembly arranged at least partially within the latch bore, the latch assembly movable between a first configuration and a second configuration, wherein in the first configuration, the latch assembly engages the outer arm such that the outer arm rotates with the inner arm, and in the second configuration, the latch assembly disengages the outer arm such that the outer arm rotates independently from the inner arm.

2. The assembly of claim 1, wherein the first and second opposed sidewalls each include an aperture configured to receive an axle.

3. The assembly of claim 2, wherein the high lift lobe contacting surface comprises a roller disposed on the axle, and each low lift lobe contacting surface comprises a contact pad.

4. The assembly of claim 1, wherein the inner arm second end includes a first post and a second post extending outwardly therefrom, the first post disposed between the inner arm second end and the outer arm, and the second post disposed between the inner arm second end and the outer arm.

5. The assembly of claim 4, further comprising a first lost motion spring disposed on the first post, and a second lost motion spring disposed on the second post.

6. The assembly of claim 5, wherein the inner arm second end includes a first tab and a second tab extending outwardly therefrom.

7. The assembly of claim 6, wherein the first lost motion spring includes a first end, a second end, and a plurality of spring coils therebetween, wherein the spring first end engages the first tab, and the spring second end engages the outer arm.

8. The assembly of claim 1, wherein the latch assembly is in a normally latched position by default, the normally latched position being the first configuration where the latch assembly engages the outer arm.

9. The assembly of claim 8, wherein the latch assembly in the normally latched position is configured to provide internal exhaust gas recirculation (IEGR) during engine startup and idle between approximately zero rpm and approximately 800 rpm.

10. An internal combustion engine, comprising:

a lash adjuster mounted to an engine block;

an engine valve configured to selectively open and close an exhaust or intake passage;

a rocker arm assembly coupled to the lash adjuster at a first end and engaged with the cylinder valve at a second end opposite the first end, the rocker arm assembly comprising:

an outer arm having first and second low lift lobe contacting surfaces;

an inner arm having first and second opposed sidewalls extending between a first end and a second end, and a high lift lobe contacting surface disposed between the first and second opposed sidewalls, the first end pivotably secured to the outer arm and engaged with the cylinder valve, and the second end pivotably secured to the lash adjuster and defining a latch bore; and a latch assembly arranged at least partially within the latch bore, the latch assembly movable between a first configuration and a second configuration, wherein in the first configuration, the latch assembly engages the outer arm such that the outer arm rotates with the inner arm, and in the second configuration, the latch assembly disengages the outer arm such that the outer arm rotates independently from the inner arm; and a cam having a high lift lobe and two low lift lobes, each of the high and low lift lobes including an actuating portion and a non-actuating portion, the cam rotating during operation of the internal combustion engine such that the actuating portions interact with the rocker arm assembly to rotate at least one of the inner and outer arms.

11. The engine of claim 10, wherein the first and second opposed sidewalls each include an aperture configured to receive an axle.

12. The engine of claim 11, wherein the high lift lobe contacting surface comprises a roller disposed on the axle, and each low lift lobe contacting surface comprises a contact pad.

13. The engine of claim 10, wherein the low lift lobes respectively contact the first and second low lift lobe contacting surfaces, and the high lift lobe contacts the high lift lobe contacting surface.

14. The engine of claim 10, wherein the inner arm second end includes a first post and a second post extending outwardly therefrom, the first post disposed between the inner arm second end and the outer arm, and the second post disposed between the inner arm second end and the outer arm.

15. The engine of claim 14, further comprising a first lost motion spring disposed on the first post, and a second lost motion spring disposed on the second post.

16. The engine of claim 15, wherein the inner arm second end includes a first tab and a second tab extending outwardly therefrom.

17. The engine of claim 16, wherein the first lost motion spring includes a first end, a second end, and a plurality of spring coils therebetween, wherein the spring first end engages the first tab, and the spring second end engages the outer arm.

18. The engine of claim 10, wherein the latch assembly is positioned over a pivot between the inner arm second end and the lash adjuster to improve static and dynamic stability.

19. The engine of claim 15, wherein the first and second lost motion springs are disposed over a pivot between the inner arm second end and the lash adjuster, and wherein the outer arm includes at least one over-travel limiter configured to contact one or more oil galleries in an overspeed condition.

20. The engine of claim 10, wherein the latch assembly is in a normally unlatched position by default, the normally unlatched position being the second configuration where the latch assembly is disengaged from the outer arm, and the normally unlatched position configured to provide internal exhaust gas recirculation (IEGR) at near idle speeds.

21. A vehicle comprising:

an internal combustion engine comprising:

a lash adjuster mounted to an engine block;

an engine valve configured to selectively open and close an exhaust or intake passage;

a rocker arm assembly coupled to the lash adjuster at a first end and engaged with the cylinder valve at a second end opposite the first end, the rocker arm assembly comprising:

(a) an outer arm having first and second low lift lobe contacting surfaces;

(b) an inner arm having first and second opposed sidewalls extending between a first end and a second end, and a high lift lobe contacting surface disposed between the first and second opposed sidewalls, the first end pivotably secured to the outer arm and engaged with the cylinder valve, and the second end pivotably secured to the lash adjuster and defining a latch bore; and (c) a latch assembly arranged at least partially within the latch bore, the latch assembly movable between a first configuration and a second configuration, wherein in the first configuration, the latch assembly engages the outer arm such that the outer arm rotates with the inner arm, and in the second configuration, the latch assembly disengages the outer arm such that the outer arm rotates independently from the inner arm; and a cam having a high lift lobe and two low lift lobes, each of the high and low lift lobes including an actuating portion and a non-actuating portion, the cam rotating during operation of the internal combustion engine such that the actuating portions interact with the rocker arm assembly to rotate at least one of the inner and outer arms; and an oil control valve system comprising an engine control unit (ECU) in signal communication with an oil control valve fluidly coupled to the latch assembly, the oil control valve configured to selectively supply a pressurized oil to the latch assembly to move the latch assembly between the first configuration and the second configuration.

22. The vehicle of claim 21, wherein the outer arm extends along a first axis, and the bore and the latch assembly extend along a second axis that is substantially parallel to the first axis and wherein the inner arm second end includes a first post and a second post extending outwardly therefrom, the first post disposed between the inner arm second end and the outer arm, and the second post disposed between the inner arm second end and the outer arm.

23. The vehicle of claim 22, further comprising a first lost motion spring disposed on the first post, and a second lost motion spring disposed on the second post, wherein the inner arm second end includes a first tab and a second tab extending outwardly therefrom, and wherein the first lost motion spring includes a first end, a second end, and a plurality of spring coils therebetween, wherein the spring first end engages the first tab, and the spring second end engages the outer arm.

24. The vehicle of claim 21, wherein the latch assembly is positioned over a pivot between the inner arm second end and the lash adjuster to improve static and dynamic stability and wherein the first and second lost motion springs are disposed over a pivot between the inner arm second end and the lash adjuster.

* * * * *